US006238457B1

(12) United States Patent
Holmi et al.

(10) Patent No.: US 6,238,457 B1
(45) Date of Patent: May 29, 2001

(54) METHOD FOR FEEDING AND DIRECTING REACTION GAS AND SOLIDS INTO A SMELTING FURNACE AND A MULTIADJUSTABLE BURNER DESIGNED FOR SAID PURPOSE

(75) Inventors: Ismo Holmi, Pori; Tuomo Jokinen, Nakkila; Launo Lilja, Pori; Jussi Sipilä , Espoo; Pekka Tuokkola, Harjavalta; Vesa Törölä , Pori; Lasse Valli, Harjavalta, all of (FI)

(73) Assignee: Outokumpu Oyj, Espoo (FI)

( * ) Notice: Subject to any disclaimer, the term of this patent is extended or adjusted under 35 U.S.C. 154(b) by 0 days.

(21) Appl. No.: 09/254,963

(22) PCT Filed: Sep. 30, 1997

(86) PCT No.: PCT/FI97/00588

§ 371 Date: Jun. 1, 1999

§ 102(e) Date: Jun. 1, 1999

(87) PCT Pub. No.: WO98/14741

PCT Pub. Date: Apr. 9, 1998

(30) Foreign Application Priority Data

Oct. 1, 1996 (FI) ..... 963932

(51) Int. Cl.[7] ..... F27D 3/18
(52) U.S. Cl. ..... 75/455; 266/221; 266/267
(58) Field of Search ..... 266/221, 216, 266/267; 75/455, 707, 454

(56) References Cited

U.S. PATENT DOCUMENTS 4,165,979 * 8/1979 Davies et al. ..... 75/455
4,326,702 * 4/1982 Oueneau et al. ..... 266/267
4,392,885 * 7/1983 Lilja et al. ..... 75/455
4,490,170 * 12/1984 Lilja et al. ..... 75/455
5,674,310 * 10/1997 Miralles et al. ..... 75/707

* cited by examiner

*Primary Examiner*—Scott Kastler
(74) *Attorney, Agent, or Firm*—Morgan & Finnegan, LLP

(57) ABSTRACT

The invention relates to a method for adjusting the flow velocity of reaction gas and the dispersion air of pulverous solids when feeding reaction gas and finely divided solids to the reaction shaft (6) of a suspension smelting furnace for creating a controlled and adjustable suspension. Reaction gas (8) is fed into the furnace from around a finely divided solid material flow (5), so that said solids are distributed with an orientation towards the reaction gas by means of dispersion air. The flow velocity and discharge direction of the reaction gas to the reaction shaft are adjusted steplessly by means of a specially shaped adjusting member (10) moving vertically in the reaction gas channel (13) and by means of a specially shaped cooling block (12) surrounding the reaction gas channel (13) and located on the arch of the reaction shaft. The velocity of the reaction gas is adjusted to be suitable, irrespective of the desired gas quantity, in the discharge orifice (14) located at the bottom edge of the reaction shaft arch (11), and from said orifice the gas is discharged into the reaction shaft (6) and forms there a suspension with the pulverous material, and the dispersion air needed for dispersing said material is adjusted according to the supply of the pulverous material. The invention also relates to a multiadjustable burner for realizing the method.

29 Claims, 4 Drawing Sheets

2
5
9
20
10
15
11
12 13
7
19

2
5
9
20
10
15
11
12 13
7
19

2
5
9
20
10
15
11
12
7
19

METHOD FOR FEEDING AND DIRECTING REACTION GAS AND SOLIDS INTO A SMELTING FURNACE AND A MULTIADJUSTABLE BURNER DESIGNED FOR SAID PURPOSE

The present invention relates to a method for feeding reaction gas and finely divided solids to a suspension smelting furnace, so that the flow velocity and flowing direction of the reaction gas and solids are adjusted at a point where the reaction gas and solids are discharged into the suspension smelting furnace. The invention also relates to a multiadjustable burner for realizing the method.

The reaction shaft of a suspension smelting furnace is vertical, and it is necessary to form a good, i.e. controlled and adjustable suspension in between the finely divided solids and reaction gas to be fed downwardly in at the top part thereof, in order to achieve for the solids a combustion that is as complete as possible. A prerequisite for the formation of a good suspension is that the suspension is not formed until the reaction space, i.e. the reaction shaft.

The finely divided solids to be fed into the suspension smelting furnace can be dispersed and distributed into the reaction shaft for instance by using a central jet distributor described in the GB patent 1,569,813. By means of said distributor, the orientation of the solids that first flow freely downwards is turned to an almost horizontal, outwardly direction prior to discharging solids into the reaction shaft. The solids are directed outwards by using a curved glide surface in the distributor and dispersion air jets directed outwardly from underneath said surface. Reaction gas is fed into the outwardly directed solids flow. The finely divided solid material is most often a concentrate.

In a normal situation, said central jet distributor with fixed perforations is sufficient; however, the use of concentrates that are difficult to make react is becoming increasingly common, and therefore a need has arisen to change dispersion also in other ways than by altering the amount of dispersion air. Because the dispersion air perforation in the concentrate distributor proper is located in the reaction space, i.e. in the reaction shaft itself, the conditions are fairly demanding, and because the perforations are also located far away and at the end of narrow channels, it is not sensible to adjust the sizes of perforations—at least not in continuous operation.

In the prior art there is known a method described in the U.S. Pat. No. 5,133,801, where on the central axis of a central jet distributor there is applied a vertical oxygen lance, through which oxygen is fed 5 . . . 15% of the total amount of oxygen. Said lance is tubular in shape, so that therein the discharge velocity and orientation of the oxygen into the furnace are, owing to the straight, stationary model, determined according to the quantity of oxygen only. Oxygen is mainly used as additional oxygen for the concentrate, to boost the reactions from the middle of the cloud of concentrate distributed by the concentrate distributor.

Generally the oxygen or oxygen-bearing gas, such as air, serving as the reaction gas, is first fed into the furnace in horizontal direction, but the gas direction must be turned to vertical prior to its feeding to the reaction shaft. The changing of the direction of the reaction gas is described in the U.S. Pat. No. 4,392,885. According to this patent describing a directional burner, the reaction gas is fed from around a pulverous solid material in an annular flow to the furnace reaction shaft through a discharge orifice with a fixed cross-sectional area.

In a normal situation it suffices to have a burner with a stationary discharge orifice for the reaction gas, but because current usage increasingly favors nearly 100% oxygen, gas quantities have been reduced to a roughly fifth part of the previous air supply. Consequently, in order to reach a given velocity for the reaction gas there is required an increasingly diminishing cross-sectional flow area for the discharge orifice of the burner. It is a fairly common requirement for the burner that it must be feasible for running a relatively wide range as for capacity and oxygen-enrichment. Because the reactions and conditions in the furnace require a certain velocity range for the reaction gas in the reaction shaft, the use of a burner with a fixed orifice leads to outside said range of acceptability. Consequently, current technology requires that the cross-sectional area of the reaction gas orifice in the burner is adjustable.

The adjusting of the reaction gas discharge orifice as such is not a problem, and there are several different ways to perform the task. The problem is to find a way of adjustment which, in addition to working in a desired fashion, also endures the rough furnace conditions, i.e the temperature (about 1400° C.), has good mechanical strength (for instance for the removal of possible build-ups with a rod), etc.

A stepwise adjustment is performed for example in a fashion described in the U.S. Pat. Nos. 5,362,032 and 5,370,369 or in the FI patent application 932458. In the first of said patents, around the concentrate distributor there are provided two cocentric annular rings of different sizes for the reaction gas. By conducting the gas to either or both rings, there are obtained three fixed discharge velocity areas. In the second patent, a desired number of discharge pipes of a desired size are closed or put to use. In the third there are "dropped" a suitable number of funnel-shaped open cones according to the case. All embodiments, however, are characterized by their stepwise nature, which means that it is not possible to bind the adjustment for instance to capacity in a continuous process.

Continuously operated systems of adjustment are described in the U.S. Pat. Nos. 4,490,170 and 4,331,087. In both systems, adjusting is based on changing the rotation power of the reaction gas, and is thus not suitable for adjusting linear velocity only.

The Japanese patent application 5-9613 utilizes a continuously operated adjustment for the reaction gas. In this application, the adjustment is a closed cone structure that moves vertically around the concentrate pipe. A reducing cone that leads reaction gas into the cylindrical discharge orifice of the burner serves as the counterpiece of said closed cone. The cones that form the flow channel are both straight (i.e. the surface wall is straight) and equiangular, so that the gas is directed to the concentrate falling in the cylinder before it reaches the distributor cone attached to the oil lance installed inside the concentrate pipe. Thus the adjusting operations are clearly carried out before the concentrate and the reaction gas are discharged into the furnace, and while discharging into the furnace, the reaction gas that is partly mixed into the concentrate has lost the velocity (and direction) it achieved through the adjustment, i.e. the discharge velocity into the furnace is determined according to the fixed discharge orifice of the burner. The direction of the adjustment is always the same: powerfully towards the middle axis, never parallel to the axis or outwards therefrom.

The above described mixing of reaction gas and concentrate carried out inside the burner is not possible with pure oxygen or with a high oxygen-enrichment, if the concentrate is easily reacting, because in that case the result is the blocking of the burner due to the sintering of the concentrate. From the point of view of adjustment, the burner operates, with respect to the furnace space, in similar fashion as any burner with a fixed orifice. Said patent application also introduces the use of oxygen and/or oil in a concentrate burner in the middle of the concentrate flow, but it does not describe in more detail any features affecting the discharge of said oxygen and/or oil.

In the method according to the present invention, the adjusting of the reaction gas velocity, and particularly of its direction as well, takes place in a reaction gas channel located around the finely divided solids flow, in which channel there is installed a vertically moving, annular and custom-shaped adjusting member. The adjusting member is connected to an adjusting device proper, which reacts to changes in the capacity and/or in the oxygen enrichment and moves the adjusting member accordingly. Advantageously the adjusting member is cooled, because it extends to the reaction space when running with a small capacity. The adjusting of the velocity and direction of the reaction gas are also affected by a shaped cooling block located on the arch of the reaction shaft, around the reaction gas channel. The cross-sectional and transversal area and direction of the reaction gas are adjusted to be such as is desired, particularly at the gas discharge orifice through which the gas is discharged to the reaction shaft of the suspension smelting furnace. The adjusting of the velocity and direction of the dispersion air takes place in two steps, i.e. air is distributed into the two channels of the distributor. The topmost perforations located nearest to the concentrate flow are designed for a normal case. When the capacity grows, dispersion air can be added through additional perforations that are located underneath said perforations and advantageously directed downwards. Additional fuel is fed with a lance from the middle of the central jet distributor. The oxygen needed for the combustion of the additional fuel is in advance divided into two parts, i.e. there are two channels leading to the distributor, and oxygen gas can be fed through said channels, either through both or only one of them. The velocity is adjusted owing to the special arrangement provided in the discharge orifice. The essential novel features of the invention are apparent from the appended patent claims.

In the multiadjustable burner according to the invention, the reaction gas that is turned essentially in the direction of the reaction shaft flows in the reaction gas channel which surrounds in an annular fashion the solids supply pipe located in the middle of the burner and in the end flows, according to the present invention, to the reaction shaft, adjusted to a desired velocity and direction, through the discharge orifice. The adjusting takes place by means of a vertically operated adjusting member, which again is located in a ring-like fashion at the inner edge of the reaction gas channel, thus surrounding the solids supply pipe. Consequently the continuous, steppless adjusting of the discharge orifice of the reaction gas channel takes place in one annulus.

The flow direction of the reaction gas, and at the same time the meeting point of the reaction gas and the concentrate flow, is determined by means of the design of the adjusting member. As for the discharge velocity, it is adjusted according to the invention by moving the adjusting member vertically, so that at the very bottom edge of the reaction shaft arch, there is always adjusted the narrowest spot that determines the discharge velocity of the reaction gas. Consequently, according to this invention, the cross-sectional flow area of the reaction gas to be fed into the reaction shaft is continuously reduced as far as the discharge orifice located at the bottom edge of the arch. The point of adjustment always remains in the same spot, i.e. at the bottom edge of the arch, but the cross-sectional area of the discharge orifice changes steplessly along with the adjusting process. This is made possible by a cooling block located on the arch, by a water-cooled adjusting member and likewise a watercooled concentrate distributor, advantageously a central jet distributor extending as far as the reaction shaft. All these are essential factors in order to achieve a controlled discharge from the burner—which is required for obtaining a good suspension and for preventing the formation of build-ups—and more specifically so that it is most effective in the reaction space itself, i.e. in the reaction shaft, and not, like in many prior art adjusting methods, so that the gas discharge is most effective inside the burner and has already lost power when entering the reaction space from the discharge orifice. It is most advantageous to adjust the reaction gas flow direction to be either parallel to the central axis of the reaction shaft, or to be directed towards the central axis.

There are several reasons for directing the reaction gas. It is well known that the velocity of the gas jet, for instance on its central axis, decreases in a linear fashion as a function of the distance and is directly proportional to the diameter of the discharge orifice. When the quantity of the reaction gas is reduced, the discharge orifice must also be reduced owing to the reasons stated above. The size of a nozzle of this type is diminished when the discharge orifice is reduced in order to maintain the velocity of the reaction gas at the reaction point.

One possible way to maintain the velocity difference between the concentrate and the reaction gas flow is to shorten the distance between the discharge orifice and the meeting point of said medium substances. This is achieved by changing the direction of the reaction gas flow. If it is desired that the meeting point be always the same, the reaction gas flow must be directed according to the changes in the starting point of the discharge orifice.

In some more difficult cases it may be advantageous to direct the reaction gas flow somewhat outwards, so that also the meeting point is shifted further from the central axis and thus from the burner itself. This type of directing is used for instance when the reaction activity should be moved "further" from the burner. It is typical of this type of method for adjusting velocity and direction that both velocity and direction can be controlled in any point of adjustment.

In an arrangement according to the present invention, the surface design both with the adjusting member and the cooling block, which both restrict the reaction gas discharge channel, is advantageously such that the edge lines of the curved surfaces are not linear but curved. The design is such that the cross-sectional flow area of the annular channel is gradually turned to a desired direction when approaching the discharge orifice. In aligning the cross-sectional surface, there is applied the known principle of a continuous diminishing cross-sectional surface. The difference is that according to the present invention, the size of the cross-sectional flow area is continuously adjustable, and that the desired direction can still be maintained.

According to the present invention, the adjusting of the velocity and particularly also of the direction of the dispersion air used for dispersing the concentrate flow thus takes place in two steps, i.e. air is divided into two channels already at the stage where it is fed into the distributor. The topmost and also the smallest perforations (primary air) that are located nearest to the concentrate flow to be distributed by means of the shaped body of the distributor are designed for a normal case. Advantageously these perforations are provided in the horizontal direction. When the capacity grows, distribution air can be added through additional perforations (secondary air) provided underneath said smallest perforations; these are advantageously larger and directed mainly downwards. From the point of view of usage it is advantageous that although other line of perforations is employed, an air current of a certain degree (10%) must be allowed to flow through the other set of perforations, too, so that a possible return flow and the blocking of the perforations is thus prevented.

The direction of the dispersion air flow, and at the same time its meeting point with the concentrate flow in the lower perforation, is normally determined to fall in a spot in the concentrate flow which is located somewhat after the meeting point of the air current discharged from the upper perforations. Now a two-step dispersion of the suspension is achieved. The lower perforations must be larger in order to maintain their velocity at least as high as that of the air discharged through the upper perforations, when the air currents meet the concentrate suspension.

According to the present invention, additional fuel, advantageously heavy oil, is fed for example by means of a commercial lance from the center of the central jet distributor. For instance pressurized air can be used for dispersing it and cooling the lance. For the oxygen that is needed in the combustion of oil, it is most advantageous to use pure oxygen, because the employed spaces are narrow. Naturally air or oxygen-enriched air can also be used, but these bring about difficulties, because the burner size also grows. It is a normal phenomenon, particularly when smelting nickel concentrate in a flash smelting furnace, that the need of additional fuel varies. Here we have the same situation as with the pressurized air used for dispersing said concentrate: it is necessary to be able to adjust the gas discharge area. Likewise we have exactly the same situation in adjusting it; adjustable perforation systems can be made, but it is not easy owing to the length of the concentrate distributor (about two meters) and the close fit of the special shaped distributor body. For this purpose, however, we have developed our own system which is fairly easy to use, as is apparent from the appended drawings. The system is further based on preliminary oxygen distribution, i.e. there are two channels leading to the distributor, into which channels we can feed oxygen gas either through both channels or only through one, but in any case so that a small leak into the "unused" channel is allowed. The velocity is maintained owing to a special arrangement in the discharge orifice, as is explained in more detail below.

The present invention fulfills both the reaction requirements (controlled velocity difference between the concentrate and the combustion gas, controlled direction of the process gas and meeting with respect to the concentrate flow) and practical requirements for running the process (simple, endures conditions, can be auto-mated for capacity variations).

The invention is further described with reference to the appended drawings, where

BRIEF DESCRIPTION OF THE DRAWINGS

FIG. 1 shows a suspension smelting furnace 1, whereto pulverous solids (concentrate) and fuel are fed through a concentrate burner 2, which in this case is a multiadjustable burner according to the invention The concentrate is shifted from the tank 3 by means of a conveyor 4 to the top part of the concentrate discharge channel 5, so that the material falls in a continuous flow via said channel 5 to the top part 7 of the reaction shaft 6 of the suspension smelting furnace 1. The reaction gas 8 is conducted from around said concentrate channel 5, in an essentially parallel direction to the reaction shaft, to the top part 7 thereof.

In FIG. 2, the reaction gas (oxygen or oxygen-enriched gas such as air) is conducted to the burner and turned to flow mainly in the direction of the central axis 9 of the reaction shaft. The discharge direction of the gas 8 into the reaction shaft is adjusted by means of an adjusting member 10 surrounding the concentrate channel 5 and by means of the design of the cooling block 12 located on the arch 11, and the discharge velocity is adjusted by means of changing the cross-sectional area of the bottom part of the reaction gas channel 13 located in between the adjusting member 10 and the block 12. The final direction and velocity of the gas are determined at the bottom edge of the arch, in the annular discharge orifice 14.

Figure 1:
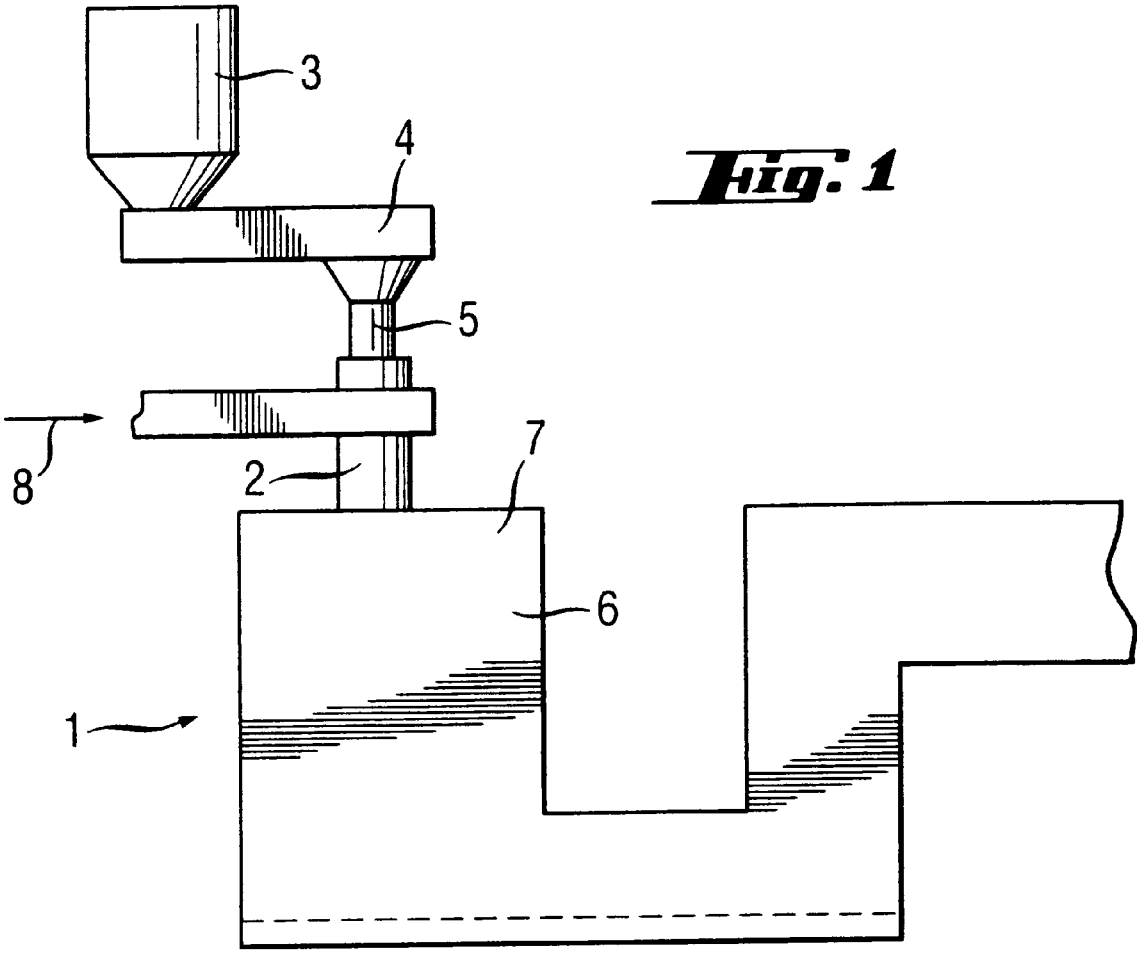
FIG. 1 is a schematical illustration of an embodiment of the present invention, i.e. a suspension smelting furnace.

The adjusting device 15 installed above the arch reacts to capacity changes and respectively moves the adjusting member 10 in the vertical direction, so that the velocity and direction of the reaction air are adjusted steplessly. The adjusting member 10 is installed a ring-like fashion at the inner edge of the reaction gas channel. The surface of the adjusting member that is located on the side of the concentrate channel 5 conforms to the shape of the concentrate channel, but the surface of the adjusting member 10 that is located towards the reaction gas channel 13 is designed so that it in all positions of the adjusting member continuously reduces the cross-sectional flow area in the flowing direction. The inner edge of the cooling block 12 that surrounds the reaction gas channel 13 in a ring-like fashion is likewise designed so that it serves as the counterpiece for the adjusting member 10, so that the cross-sectional area of the reaction gas channel 13 ending at the discharge orifice 14 is continuously reduced when proceeding downwards.

From the point of view of durability and feasibility, it is advantageous that the block 12, the adjusting member 10 and the concentrate channel 5 are cooled (for instance with water), because for example the adjusting member 10 in its high position extends essentially as far as the bottom edge of the arch 11, and in its low position to inside the reaction shaft. Also the concentrate channel 5 extends to underneath the arch 11, to the reaction shaft. The cooling water circulation of the block is marked with the reference number 16, the cooling of the discharge orifice adjusting member with number 17 and the cooling of the concentrate channel with number 18. An effective mixing effect that is advantageous for the reactions is achieved by utilizing a concentrate distributor 19, to be described in more detail in FIG. 4, for turning the direction of the pulverous material and for increasing its velocity and state of dispersion.

Figures 3, 3A, 3B, 3C:
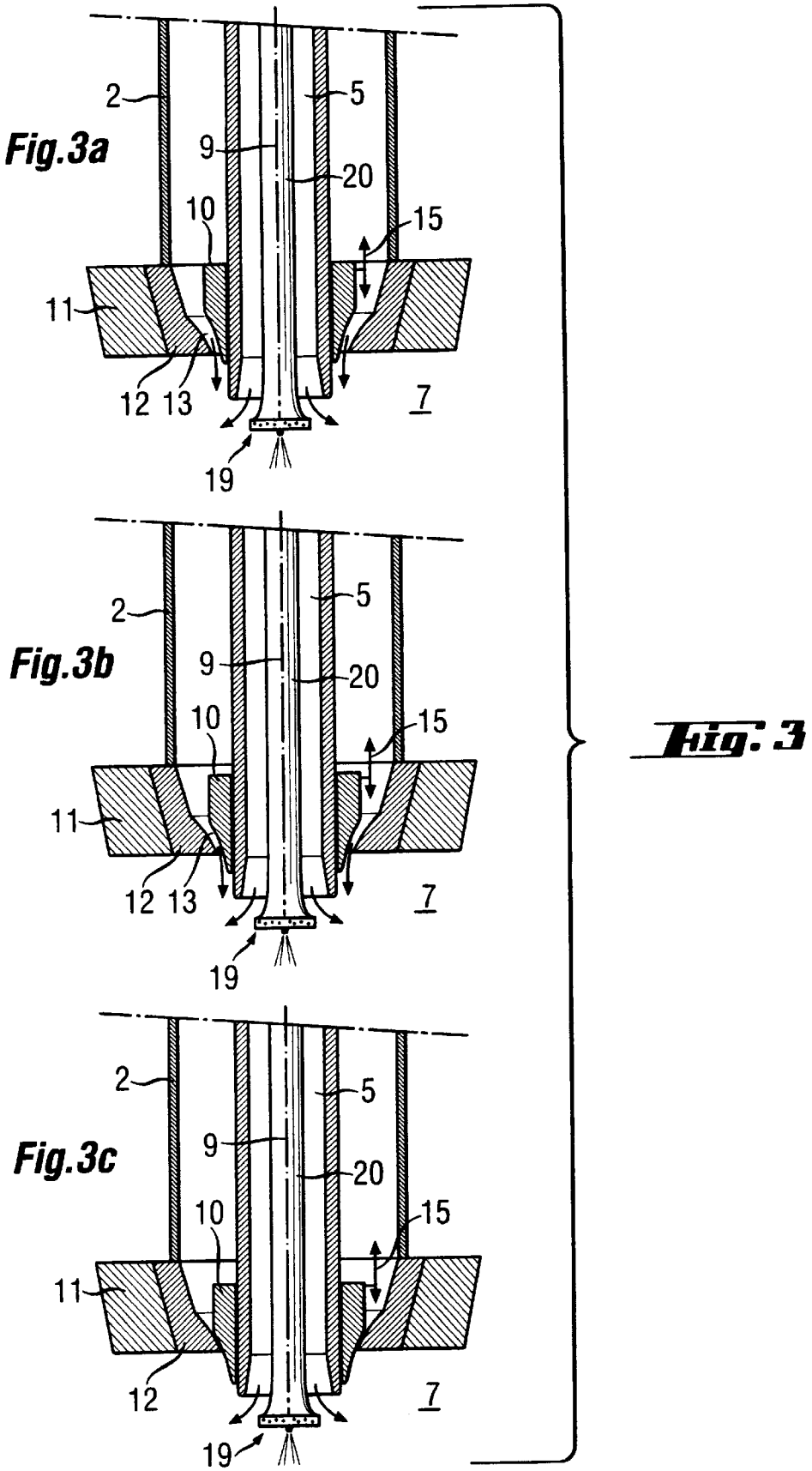
FIG. 3 shows three different positions of adjustment in order to illustrate the reaction gas adjusting process in FIGS. 3A, 3B and 3C.

FIG. 3*a* illustrates a case where the capacity is normal, i.e. fairly near to maximum. Now the adjusting member 10 is located relatively high and under a fairly low heat strain. The velocity conforms to the process requirements and is for example 80 . . . 100 m/s. This design of the channel directs the gas somewhat towards the central axis 9.

FIG. 3*b* illustrates a case where the capacity is smaller than normal, i.e fairly far from maximum. Now the adjusting member 10 is lowered, so that the velocity can be maintained according to the process requirements, for example at 80 . . . 100 m/s. This design of the channel also directs the gas somewhat towards the central axis 9.

FIG. 3*c* introduces a case where the capacity is low, i.e fairly near to minimum Now the adjusting member 10 is lowered even further down, so that the velocity can again be maintained according to the process requirements, for example at 80 . . . 10 m/s. This design of the channel also directs the gas somewhat towards the central axis 9.

Figure 2:
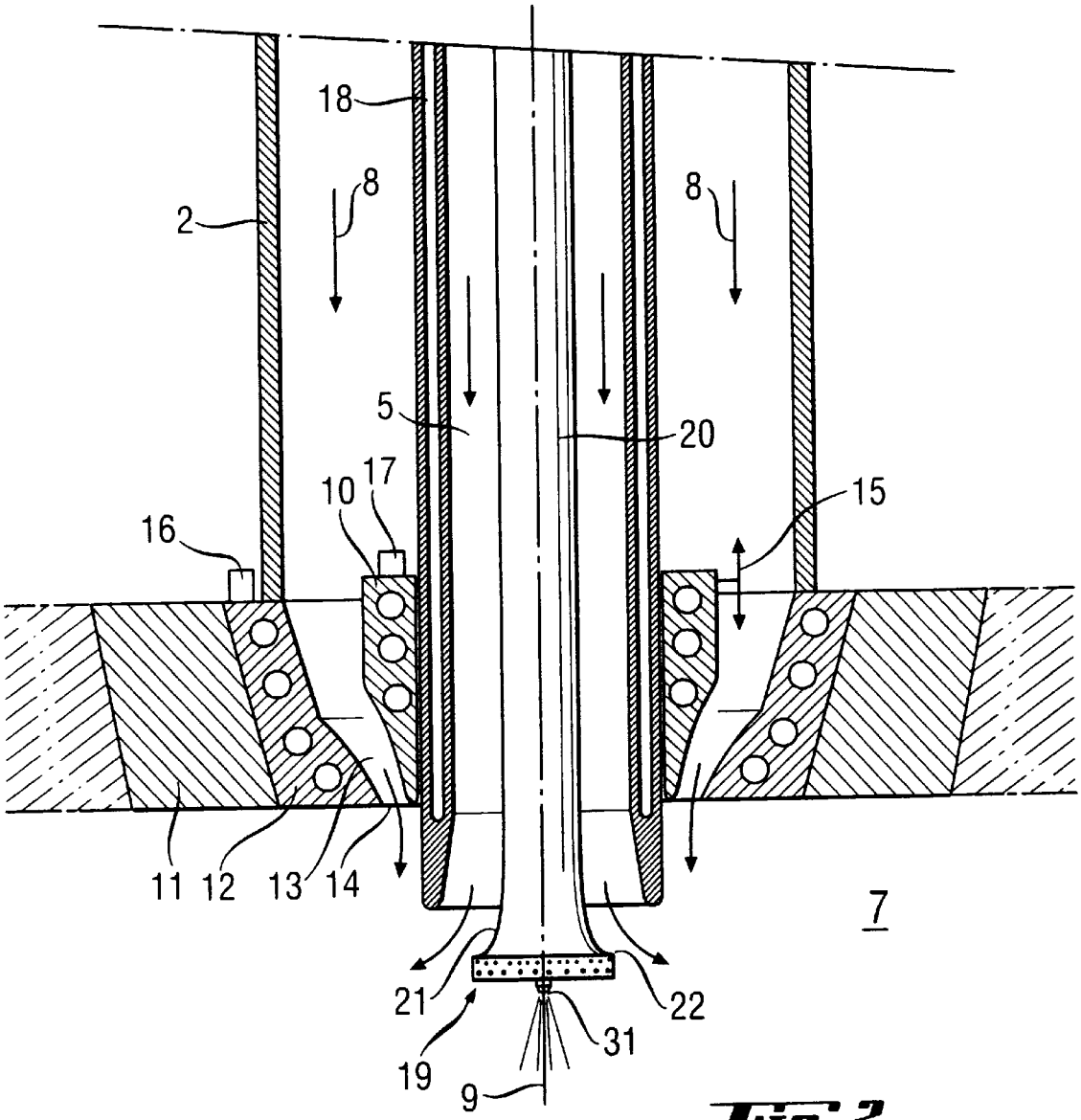
FIG. 2 illustrates in vertical cross-section a reaction gas adjusting arrangement, located in the burner discharge orifice around the concentrate distributor.
Figure 4:
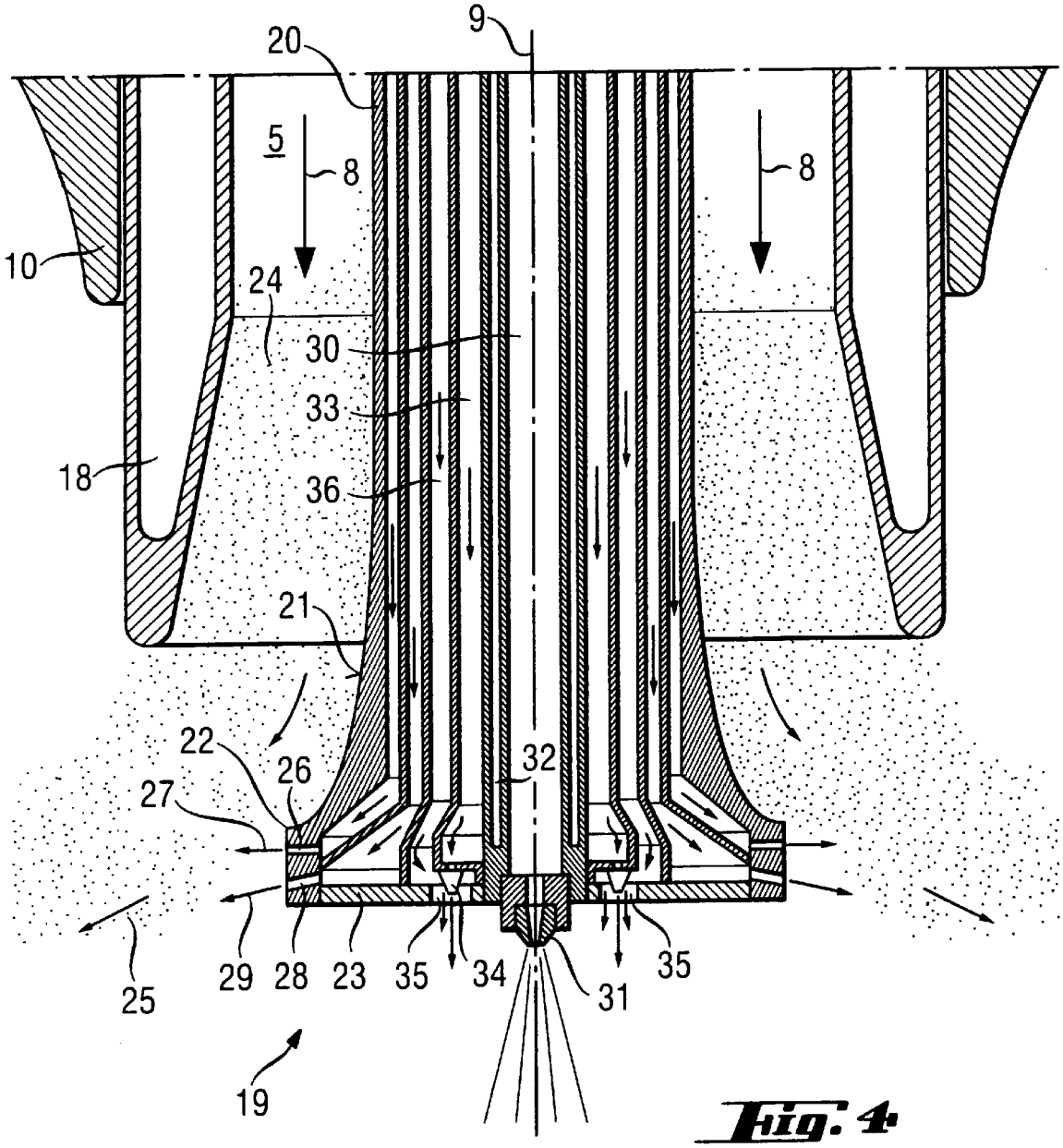
FIG. 4 illustrates in more detail a concentrate distributor according to the invention and the apparatus for feeding oxygen or additional fuel.

According to FIG. 4, the concentrate distributor 19 is arranged inside the concentrate channel 5, so that the tubular part 20 of the concentrate distributor located within the concentrate channel continues, underneath the bottom edge of the concentrate channel, as a curved shaped body 21, which ends at the essentially horizontal terminal edge 22. The concentrate distributor is provided with a bottom plate 23. As is seen in FIG. 2, the bottom parts of both the concentrate channel and the concentrate distributor are located in the furnace space of the reaction shaft. The concentrate 24 falling down along the concentrate channel 5 meets the spreading and distributing stationary shaped surface 21, owing to which the concentrate flow turns mainly horizontally outwards, thus forming an umbrella-like concentrate spray 25. In addition to the shaped surface, the turning of the concentrate flow is enhanced by means of perforations provided in the bottom edge of the shaped body. Through the holes in the perforation row 26, towards the concentrate flow there is directed a dispersion air jet that turns the direction of the concentrate. The perforations adjust the velocity of said pressurized air according to the quantity of the concentrate. In a normal case the direction of the perforation is horizontally outwards from the central axis of the distributor. When the concentrate flow is separated from the shaped surface 21, it is collided by the dispersion air 27 discharging from the perforation row 26, so that the concentrate and the dispersion air are mixed together into a loose suspension and provide the suspension with additional energy symmetrically towards the side. The dispersion and additional distribution of the concentrate depends on the impulse of the employed dispersion air, i.e. its quantity and velocity.

Additional energy is needed along with the growth of the concentrate feeding capacity. This may be achieved by increasing the dispersion air quantity, but if the air quantity is raised with a dispersion air system provided with fixed perforations, the required pressure rises unnecessarily high, wherefore it is advantageous to obtain additional cross-sectional area for the perforation. In the present invention this is, according to FIG. 4, arranged with an additional perforation row 28. Said additional perforations are arranged underneath the above described perforation row 26, in the same distributor body. The holes in the lower perforation row 28 are larger than the holes in the upper perforation row 26, because it is known that this is a way to maintain the velocity of the discharging air jet higher than with smaller holes. This is due to the fact that the air discharging from the lower perforation row meets the solids further away than the air jets discharging from the upper perforations. The meeting point of the concentrate and the air jets is shifted further by directing the holes of the perforation row 28 somewhat downwards. The air jet 29 discharging from the lower holes further boosts the mixing of the jet discharged from the upper holes and the concentrate. The final reaction is reached when the reaction gas, with adjusted velocity and direction, is discharged through the orifice 14 to this dispersed concentrate suspension.

Suspension smelting, i.e. flash smelting, is generally autogenous, i.e. additional heat brought about by additional fuel is essentially not needed, because the reactions between the concentrate and oxygen are very exothermic. However, for practical reasons it is often necessary to feed small amounts of additional fuel to the furnace. Among the affecting factors let us point out the quality of the concentrate. Particularly when feeding nickel concentrate it is often necessary to use small amounts of additional fuel. Moreover, the feeding of additional fuel/nickel concentrate varies considerably, so that the fuel supply must also be adjustable. Additional fuel, advantageously heavy fuel oil, is fed through a fuel pipe 30 installed in the middle of the distributor and is injected into the furnace underneath the concentrate distributor, via a dispersing nozzle 31. For this purpose there are available suitable commercial nozzles with a sufficient range of operation for the capacity changes. The oil lance extends from the middle of the distributor to the furnace space of the reaction shaft, wherefore it should be cooled; for the cooling, it is advantageous to use air that is discharged from around the lance via an annular pipe 32.

The quantity of oxygen required for the combustion of the additional fuel is so large that the amount of cooling air is not sufficient, but in order to burn the oil it is necessary to feed oxygen into the furnace, and the oxygen amount must be adjustable. In this case, when operating with a normal or small capacity, the required oxygen, so-called primary oxygen, is fed, through an annular channel 33 surrounding the oil lance and its cooling air pipe, to several fixed nozzles 34 attached at the far end of the channel, through which nozzles the oxygen is fed into the reaction shaft. The number of nozzles is 3–12, advantageously 6–10, so that a jet-like effect is created. The nozzles are located symmetrically around the fuel nozzle 31. From the nozzles 34 the primary oxygen is first discharged through secondary holes 35 provided in the distributor bottom plate 23, underneath the primary nozzles, to the furnace space. The holes 35 are somewhat larger than the primary nozzles 34, i.e. to such extent that the discharged primary oxygen maintains its discharge velocity depending on the quantity and nozzle size, thus mixing to the oil spray discharged through the oil nozzle 31 at a controlled space and thus forming a combustible oil mixture.

If there is need for additional combustion, the quantity of the secondary oxygen that is fed mainly as a "leak" is increased in the secondary oxygen channel 36 surrounding the primary oxygen channel 33. This addition is carried out so that in the discharge holes 35 of this secondary oxygen channel, there is achieved nearly the same velocity as in the primary nozzles 34. Said velocity is determined according to the sum of the primary and secondary oxygen quantities and the area of the secondary holes 35. Now the additional combustion with the correct velocity of the combustion mixture is formed by said total oxygen.

EXAMPLE 1

Known concentrate burner systems are used in a flash smelting furnace, i.e. there are used the above described directional burner and central jet distributor, as well as an oxygen lance arranged in the middle of the distributor. The concentrate is sulfidic copper concentrate, with a quantity of 50 t/h, with a sand addition of about 10%. The employed reaction gas is 98% oxygen gas, of which amount 5–15% is fed through the central lance of the distributor, and the rest through the directional burner. When designed accordingly, the outer water-cooled shell of the central jet distributor is about ø 500 mm. This means that in order to achieve a sensible discharge velocity, the size obtained for the aperture of the annulus—that has a diameter of a good 500 mm—in the discharge orifice of the directional burner is about 20 mm. This also means that in order to avoid asymmetry, the discharge orifice structures must be solid and accurately centered.

If for some reason it is impossible to use so high oxygen-enrichment, but the combustion gas must be replaced with air, this first of all means that the quantity of reaction gas is increased five times. When it is also taken into account that the air must be preheated up to at least 200° C., the reaction gas discharge velocity to the shaft will rise, with said burner with a fixed orifice and with the same capacity, to roughly eight-fold. This velocity is in many senses too high. Among other things, pressure requirements for the reaction gas increase to an order of 40 times as high as earlier. There is often no other alternative than to decrease the capacity, so that a sensible running area is achieved.

Let us now use the method and burner according to the present invention. When running with a high oxygen-enrichment, adjustment is carried out so that the adjusting member 10 is low (FIG. 3*c*), so that the aperture 14 of the annular discharge orifice is of the order 20 mm and velocity on the level of said normal burner. When air must be used with preliminary heating, the adjusting member is raised higher (FIG. 3*a* or 3*b*), so that said aperture 14 at the bottom end of the discharge is of the order 50 . . . 60 mm, and the obtained velocity is rendered moderate again.

EXAMPLE 2

This example describes the adjusting of the quantity of oxygen to be fed from around an oil lance arranged inside a concentrate distributor 19. The excellent functionality of the method and apparatus according to the invention for adjusting the velocity of the oxygen needed for burning the oil is best apparent from the following series of measurements. The aim is to adjust the velocity with a fixed oxygen discharge arrangement that is located inside a shaped body used for concentrate distribution and is opened at the bottom, around the oil lance 31. From the point of view of the reactions between the concentrate, oil and oxygen it is important that the oxygen velocity can be maintained sufficiently high. It is a difficult task, because we are talking about closed quarters and a high temperature in the reaction shaft, and the concentrate tends to be easily sintered to the apertures if there is no gas flow towards the furnace. Therefore any mechanical adjusting of the aperture size is out of question, as are apertures that should be utilized only from time to time.

According to the present invention, the multiadjustable burner can also be utilized in critical areas, i. e. with low and high capacity. The oxygen supply needed by the additional fuel is taken care of by feeding the oxygen via the primary oxygen channel 33, and high capacity by feeding oxygen through both the primary and secondary oxygen channel 36. With a low capacity, the oxygen velocity is determined according to the velocity ($w=w_s=V_s/A_s$) of the gas discharged from the nozzle 34 located at the end of the primary channel 33, and thus not according to the discharge hole 35. The subindex s refers to the nozzle 34. With high capacity, the velocity is determined according to the gas velocity ($w=w_o=(V_s+V_o)/A_o$), where the subindex o refers to the discharge hole 35.

What is said above can be verified from the following series of measurements, which for the sake of clarity was carried out with one partial unit only (one nozzle 34 and one discharge hole 35). Accordingly, in the measurement there were two nested pipes, of which the outer and inner measures of the primary oxygen channel were ø30/20 mm and of the secondary oxygen channel ø60/50 mm. The distance of the nozzle 34 from the discharge hole 35 was 20 mm, and the diameter of the discharge hole 35 was 30 mm. The velocity was measured at a distance of 105 mm from the discharge hole. In the table below, the letter S denotes to the primary oxygen channel, and the letter U denotes to the secondary oxygen channel, the letter O denotes to the discharge hole and the letter X the point of measurement.

Particularly Table 2 proves the good functional properties of the invention (the velocity $w_x$/corresponding feeding velocities $w_s$, $w_u$ and $w_o$ measured at the distance 105 mm). In the cases 1 and 2, oxygen is fed only through the primary oxygen channel, and in the case 3 also through the secondary oxygen channel, and as is seen from this table, the gas velocities at the distance x are located in the same area irrespective of their quantity.

TABLE 1

| Quantity | Symbol | Quality | S | U | 0 | X |
|---|---|---|---|---|---|---|
| Cross-sectional area | A | $mm^2$ | 314 | 1257 | 707 | |
| Temperature | T | K | 300 | 300 | 300 | 300 |
| Gas flow 1 | $V_n1$ | $m^3/h$ | 20 | 0 | 20 | |
| Gas flow 2 | $V_n2$ | $m^3/h$ | 10 | 0 | 10 | |
| Gas flow 3 | $V_n3$ | $m^3/h$ | 20 | 40 | 60 | |
| Gas velocity 1 | $w_1$ | m/s | 19.4 | 0 | 8.6 | 9.5 |
| Gas velocity 2 | $w_2$ | m/s | 9.7 | 0 | 4.3 | 5.3 |
| Gas velocity 3 | $w_3$ | m/s | 19.4 | 9.7 | 25.8 | 16.9 |

TABLE 2

| Case | $w_x/w_s$ | $w_x/w_u$ | $w_x/w_o$ |
|---|---|---|---|
| 1 | 0.49 | infinite | 1.10 |
| 2 | 0.55 | infinite | 1.23 |
| 3 | 0.87 | 1.74 | 0.66 |

What is claimed is:

1. A method for adjusting flow velocity of reaction gas and dispersion air of pulverous solid material when feeding reaction gas and finely divided solids to a reaction shaft of a suspension smelting furnace for creating a controlled and adjustable suspension, where reaction gas is fed into the furnace from around a finely divided solid material flow, said solids being distributed with an orientation towards the reaction gas by means of dispersion air, wherein the flow velocity and discharge direction of the reaction gas to the reaction shaft are adjusted steplessly by means of a specially shaped adjusting member moving vertically in a reaction gas channel and by means of a specially shaped cooling block surrounding the reaction gas channel and located on an arch of the reaction shaft, so that the velocity of the reaction gas is adjusted to be suitable, irrespective of the gas quantity, in a discharge orifice located at a bottom edge of the reaction shaft arch, from which orifice the gas is discharged into the reaction shaft and forms there a suspension with the pulverous solid material, and the dispersion air needed for dispersing said material is adjusted according to the supply of the pulverous solid material, wherein the adjusting member adjusting the cross-sectional area and orientation of the reaction gas flow is cooled, and wherein curved surfaces of the adjusting member and of the cooling block located on the side of the reaction gas channel are designed so as to reduce the cross-sectional flow area in the discharge direction of the reaction gas.

2. A method according to claim 1, wherein the reaction gas flow velocity is adjusted in one annulus.

3. A method according to claim 1, wherein the direction of the reaction gas is adjusted to be turned away from the central axis of the reaction shaft.

4. A method according to claim 1, wherein the direction of the reaction gas is adjusted to be parallel to the central axis of the reaction shaft.

5. A method according to claim 1, wherein primary dispersion air of the pulverous solid materials is fed horizontally outwards from the central axis of the reaction shaft.

6. A method according to claim 1, wherein secondary dispersion air of the pulverous solid material is fed in underneath primary dispersion air.

7. A method according to claim 1, wherein secondary dispersion air of the pulverous solid material is fed in so as to be directed lower than primary dispersion air.

8. A method according to claim 1, wherein fuel is fed into the reaction shaft from inside the flow of the pulverous solid material.

9. A method according to claim 1, wherein oxygen is fed into the reaction shaft from inside the flow of the pulverous solid material.

10. A method according to claim 1, wherein fuel and oxygen are fed into the reaction shaft from inside the flow of pulverous solid material.

11. A method according to claim 1, from inside the flow of pulverous solid material, oxygen is fed in to the reaction shaft in an annular fashion from around a fuel supply.

12. A method according to claim 1, from inside the flow of pulverous solid material, oxygen is fed into the reaction shaft in two annular flows from around a fuel supply.

13. A method according to claim 1, by means of the adjusting member and the cooling block, the reaction gas velocity is adjusted to be constant.

14. A multiadjustable burner for feeding reaction gas and fmely divided solid material into a reaction shaft, said burner comprising a distributor member located inside a pulverous solids material discharge channel, said distributor member being provided with dispersion air perforations, and a reaction gas channel surrounding the discharge channel in an annular fashion, wherein in order to steplessly adjust flow velocity and direction of the reaction gas, the reaction gas channel is provided with a vertically moving annular adjusting member installed at an inner edge of the reaction gas channel, wherein the adjusting member is provided with cooling means and that on a reaction shaft arch there is arranged a cooling block surrounding the reaction gas channel, so that surfaces of the adjusting member and the block that are located towards the reaction gas channel are in all positions of the adjusting member designed to adjust the cross-sectional flow area to be smallest in a discharge orifice located at a bottom edge of the arch, and that a distributor member of finely divided material is underneath a shaped surface provided with two rows of perforations.

15. A multiadjustable burner according to claim 14, wherein the vertical motion of the adjusting member is created by means of an adjusting device that is located on top of the arch and reacts to variations in capacity and/or oxygen-enrichment.

16. A multiadjustable burner according to claim 14, wherein the pulverous solid material discharge channel is provided with cooling means.

17. A multiadjustable burner according to claim 14, wherein the adjusting member has a top position and in its top position extends essentially as far as the bottom edge of the arch.

18. A multiadjustable burner according to claim 14, wherein the adjusting member extends to a top part of the reaction shaft.

19. A multiadjustable burner according to claim 14, wherein an outer surface of the adjusting member and an inner surface of the block are designed so that the reaction gas channel is directed away from the central axis of the reaction shaft.

20. A multiadjustable burner according to claim 14, wherein an outer surface of the adjusting member and an inner surface of the block are designed so that the reaction gas channel is parallel to the central axis of the reaction shaft.

21. A multiadjustable burner according to claim 14, wherein an upper row of perforations in the shaped body is directed essentially horizontally.

22. A multiadjustable burner according to claim 14, wherein a lower row of perforations of the shaped body is directed to be downwards inclined.

23. A multiadjustable burner according to claim 14, wherein holes in a lower perforation row of the shaped body are larger than holes in an upper perforation row.

24. A multiadjustable burner according to claim 14, wherein inside the concentrate distributor, there is installed a fuel pipe (30) and a cooling air pipe surrounding it.

25. A multiadjustable burner according to claim 24, wherein around the fuel pipe and the cooling pipe installed inside the concentrate distributor, there is an annular primary oxygen channel.

26. A multiadjustable burner according to claim 24, wherein around the fuel pipe and the cooling pipe installed inside the concentrate distributor, there are an annular primary oxygen channel and an annular secondary oxygen channel.

27. A multiadjustable burner according to claim 25, wherein an outermost end of the primary oxygen channel is provided with nozzles (34).

28. A multiadjustable burner according to claim 25, wherein the distributor has a bottom plate and the bottom plate of the distributor is provided with secondary holes.

29. A multiadjustable burner according to claim 28, wherein the bottom plate of the distributor is provided with secondary holes which are larger than holes in the primary nozzles.

* * * * *